US006725969B1

(12) United States Patent
Meister

(10) Patent No.: US 6,725,969 B1
(45) Date of Patent: Apr. 27, 2004

(54) CATCH DEVICE FOR A CLIMBING PROTECTION SYSTEM

(75) Inventor: Klaus Meister, Helmbrechts (DE)

(73) Assignee: Christian Dalloz Holding Deutschland GmbH & Co. KG, Hof (DE)

( * ) Notice: Subject to any disclaimer, the term of this patent is extended or adjusted under 35 U.S.C. 154(b) by 0 days.

(21) Appl. No.: 10/148,675

(22) PCT Filed: Nov. 29, 2000

(86) PCT No.: PCT/EP00/11967

§ 371 (c)(1),
(2), (4) Date: Oct. 15, 2002

(87) PCT Pub. No.: WO01/40611

PCT Pub. Date: Jul. 6, 2001

(30) Foreign Application Priority Data

Nov. 29, 1999 (DE) ..... 299 20 850

(51) Int. Cl.[7] ..... A47L 3/04; E04G 3/14
(52) U.S. Cl. ..... 182/8; 182/3; 182/36
(58) Field of Search ..... 182/8, 3, 36, 5, 182/133–135, 143, 230, 72, 192, 191, 239, 237, 236, 231, 232, 7, 6; 188/65.2, 65.1, 65.3, 65.4; 24/134 R

(56) References Cited

U.S. PATENT DOCUMENTS 2,616,609 A 11/1952 Herod
3,348,632 A * 10/1967 Swager ..... 182/230
4,059,871 A * 11/1977 Swager ..... 24/134 R
4,085,818 A * 4/1978 Swager ..... 182/48
4,111,280 A * 9/1978 Devine et al. ..... 182/8
4,193,475 A * 3/1980 Sweet et al. ..... 182/8
4,269,284 A * 5/1981 Swager ..... 182/8
4,499,966 A * 2/1985 Milne et al. ..... 182/3
5,238,084 A * 8/1993 Swager ..... 182/8

FOREIGN PATENT DOCUMENTS

FR 1.336.836 7/1963

* cited by examiner

*Primary Examiner*—Hugh B. Thompson, II
(74) *Attorney, Agent, or Firm*—Hoffman & Baron, LLP

(57) ABSTRACT

A fall arrester for a climbing protection system to prevent a person from falling from a ladder, platform, or similar structure. The fall arrester can be guided in a guide rail and has a housing and a pawl with an attachment point where the person to be secured is attached. The pawl is swivellable between an unlocked and a locked position of the fall arrester so that in the unlocked position, the connection line between the rotational axis and the attachment point form an acute angle to the horizontal, and the torque exerted by the spring on the pawl is less than the torque produced by the weight force of the fall arrester when the fall arrester is held at the attachment point.

2 Claims, 3 Drawing Sheets

CATCH DEVICE FOR A CLIMBING PROTECTION SYSTEM

Figure 2:
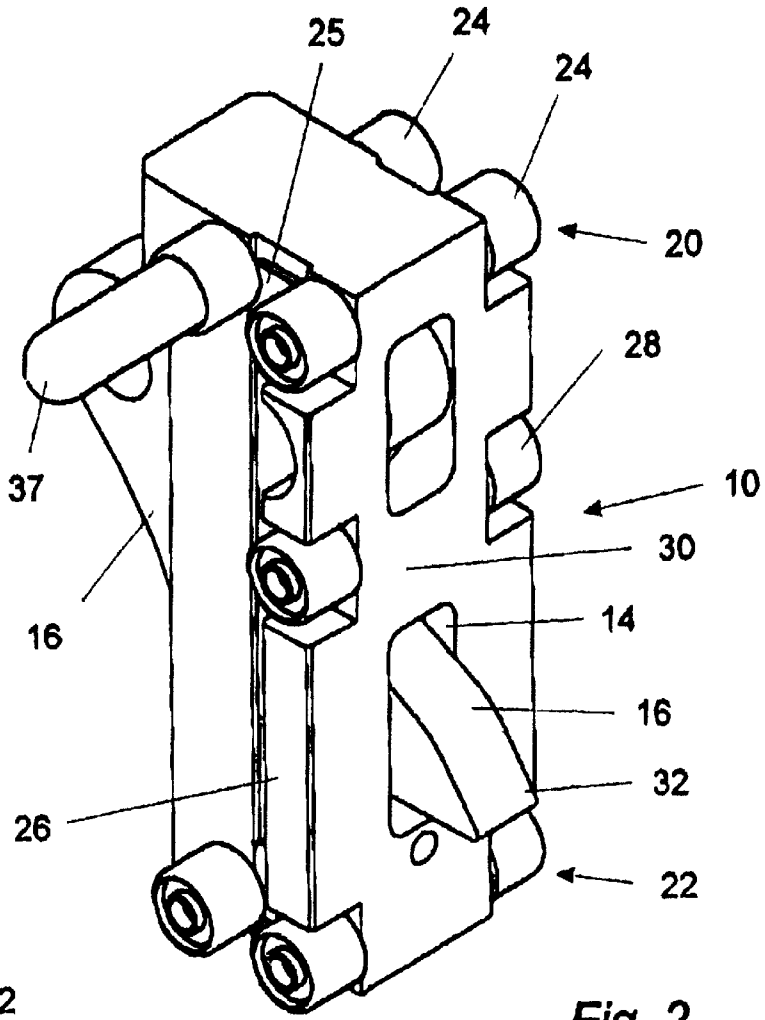

This application is a continuation of PCT/EP00/11967, filed Nov. 29, 2000.

The invention relates to a fall arrester for a climbing protection system to prevent a person falling from a ladder, a platform or similar. The fall arrester runs in a guide rail. The person to be secured wears a safety belt and is connected to the fall arrester by a connection means. The fall arrester has a runner or carriage which runs in the guide rail. The runner has a housing and a pawl rotatably housed therein which is loaded by a spring. The spring presses the pawl into a locked position. In the event of a fall, the pawl then strikes against catching stops or a perforation in the guide rail. The connection means are secured at an attachment point of the pawl. For descent, the pawl is swivelled against the force of the spring into an unlocked position.

Such a fall arrester which is suitable for a climbing protection system is known from EP-A-0 168 021, DE-A-27 36 037 and DE-A-19 61 757. With these climbing protection systems, a guide rail with a C profile is used. The edges of the longitudinally-running opening of the C profile are the guide flanges on which the fall arrester is guided. In the rear wall of the C profile, catching stops are pushed out or recesses are punched, against which the pawl runs in the event of a fall so that arrest takes place in form-locking manner.

The pawl points downwards so that during ascent, the pawl travels over the catching stop or the perforation in the rear wall of the C profile. During descent along the ladder, the user leans backwards (back-pull) so that the pawl is pulled away from the rear wall of the guide rail and the carriage can travel downwards unimpeded.

With these fall arresters, the connection line of the fulcrum of the pawl and the attachment point form an acute angle of approx. 30° to the horizontal, and the pawl is swivelled by approx. 25 to 30° out of the completely unlocked position into the completely locked position. For reasons of operational safety, the pawl is pressed into the locked position by a relatively powerful spring. To distribute the load and the abrasion on the rollers, the fulcrum of the pawl is approximately in the centre between the two axes of the rollers.

In some cases, a descent with back-pull is not possible. To be able to climb through narrow manhole covers, shafts, cage ladders etc., the person ascending or descending must stay close to the ladder. As a result of the absence of back-pull, the pawl is pressed by the spring into the guide rail profile so that the fall arrester is held by the catching stops or the perforation in the rear wall of the guide rail, and descent is not possible. To use the fall arrester in such cases, special runners are used which are constructed such that the weight force of the body of the runner is greater than the force of the spring loading the pawl, so that the pawl is unlocked when the fall arrester is held at the attachment point.

A fall arrester is known in which, in the unlocked position, the attachment point lies above the horizontal passing through the fulcrum of the pawl. The fall arrester can be used only for descent without back-pull, as the pawl would be pulled into the locked position by the back-pull. The object of the invention is to provide a fall arrester with which ascent into narrow shafts is possible without problems (descent without back-pull), but which can also be used in conventional manner on ladders (descent with back-pull).

This object is achieved according to the invention in that the fall arrester is unlocked when the connection line between fulcrum of the pawl and attachment point forms an angle of less than 2° to the horizontal and the spring exerts a torque on the pawl which is less than the torque produced by the weight of the fall arrester when the fall arrester is held at the attachment point.

If the two above-named conditions are combined in a fall arrester, the latter can be used universally in all conditions and simultaneously provides the user with the greatest comfort.

Upon descent with back-pull, an angle of approx. 2° to the horizontal forms in the connection means, the person introducing a force of up to 600 N into the connection means. Because of differences in friction between runner and guide rail or the condition of the guide rail, this angle can be slightly smaller (0°) or larger (4°). If an unimpeded descent is now desired, the pawl must remain in this 0° to 4° range, drawn by the back-pull, in any case.

The attachment point of the pawl lies below the horizontal passing through the fulcrum of the pawl. Preferably, the connection line of attachment point and fulcrum of the pawl forms an angle of approx. 5° to the horizontal when the pawl is in the unlocked position. The result of this is that, during descent with back-pull, the pawl is in the unlocked position in an operationally safe manner.

The pawl advantageously reaches the locked position through swivelling by only approx. 150°. The pawl projects so far from the underside of the runner that it strikes against the catching stops or the perforation in the rear wall of the guide rail. To achieve a sufficient displacement of the tip of the pawl between the unlocked and the locked position despite this relatively small swivel angle, the distance from the tip to the fulcrum is as great as possible. For this purpose, the fulcrum is advantageously located at the top end of the runner and the tip of the pawl at the bottom end.

Because of the small angle at which the attachment point lies below the horizontal at which in the unlocked position, and the small swivel angle between unlocked and locked positions, the horizontal path which the attachment point covers between both positions is very short. Despite the relatively slight force of the spring, full operational safety is therefore guaranteed.

Overall, the runner is an approximately rectangular housing with a central opening. The pawl is housed in the central opening rotatably about a horizontal rotational axis.

The fall arrester is guided by guide devices in the guide rail. The guide devices lie on the outside and inside at the guide flanges of the guide rail. The guide devices are provided at the top and bottom ends of the runner and can each, as known from DE 299 06 047, have two pairs of fixed rollers. Preferably, in the fall arrester according to the invention, two additional fixed rollers are provided which, during use, are located inside the guide rail, the fulcrum of the pawl lying approximately between these additional rollers and the guide device at the top end of the fall arrester.

Figure 1:
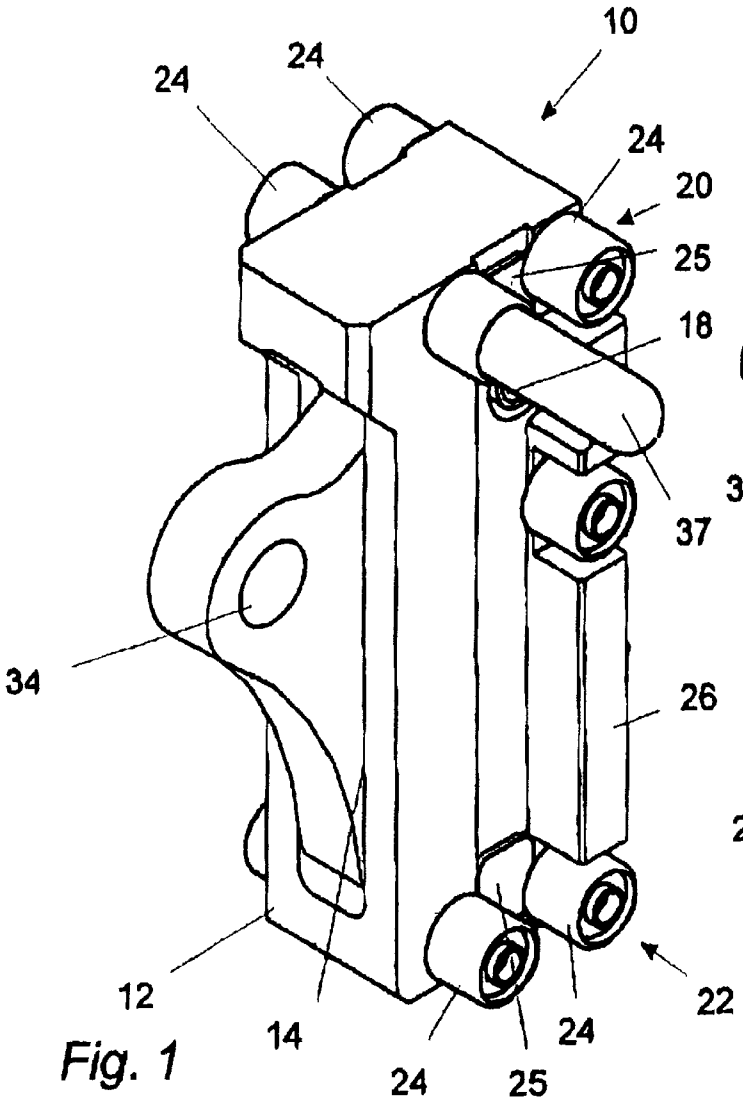
Figure 3:
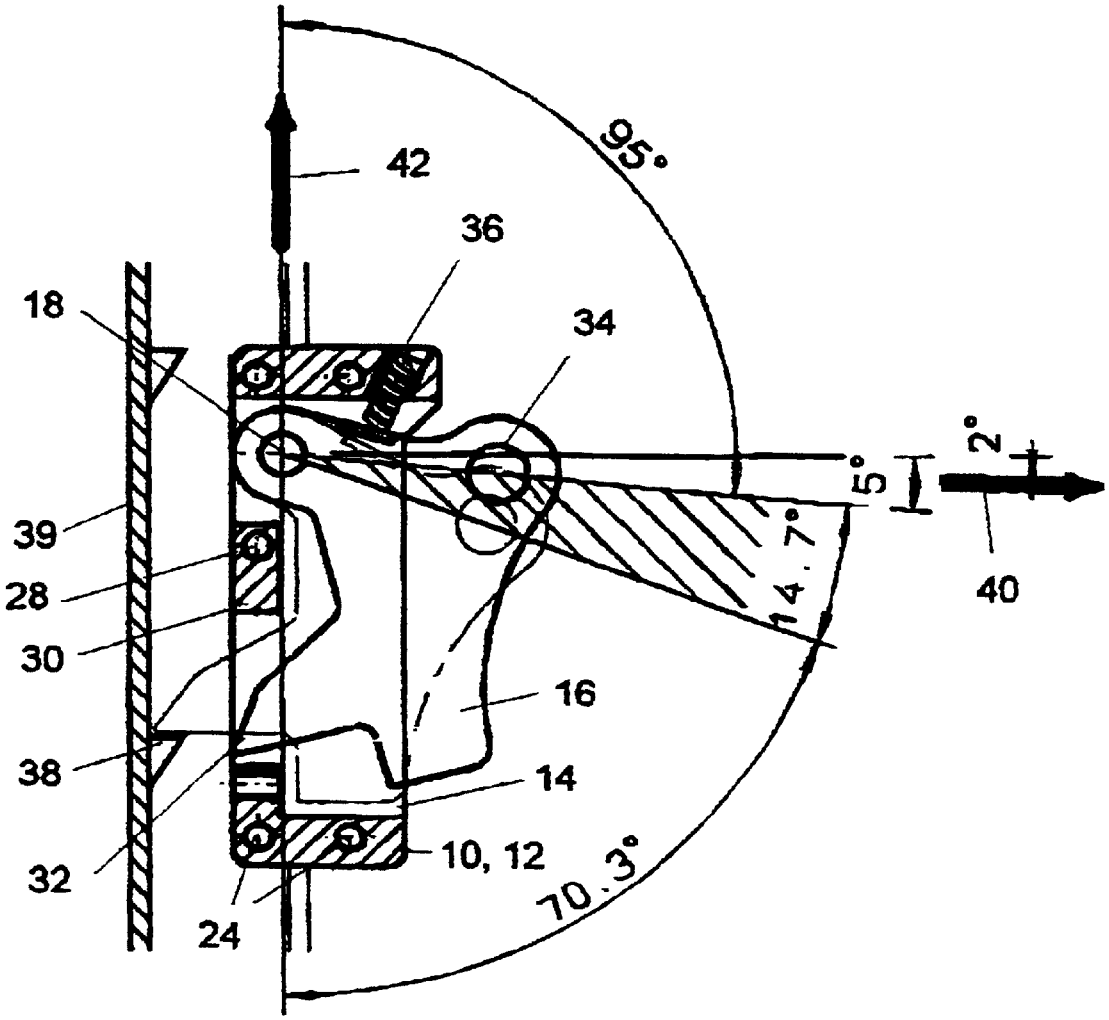
Figure 4:
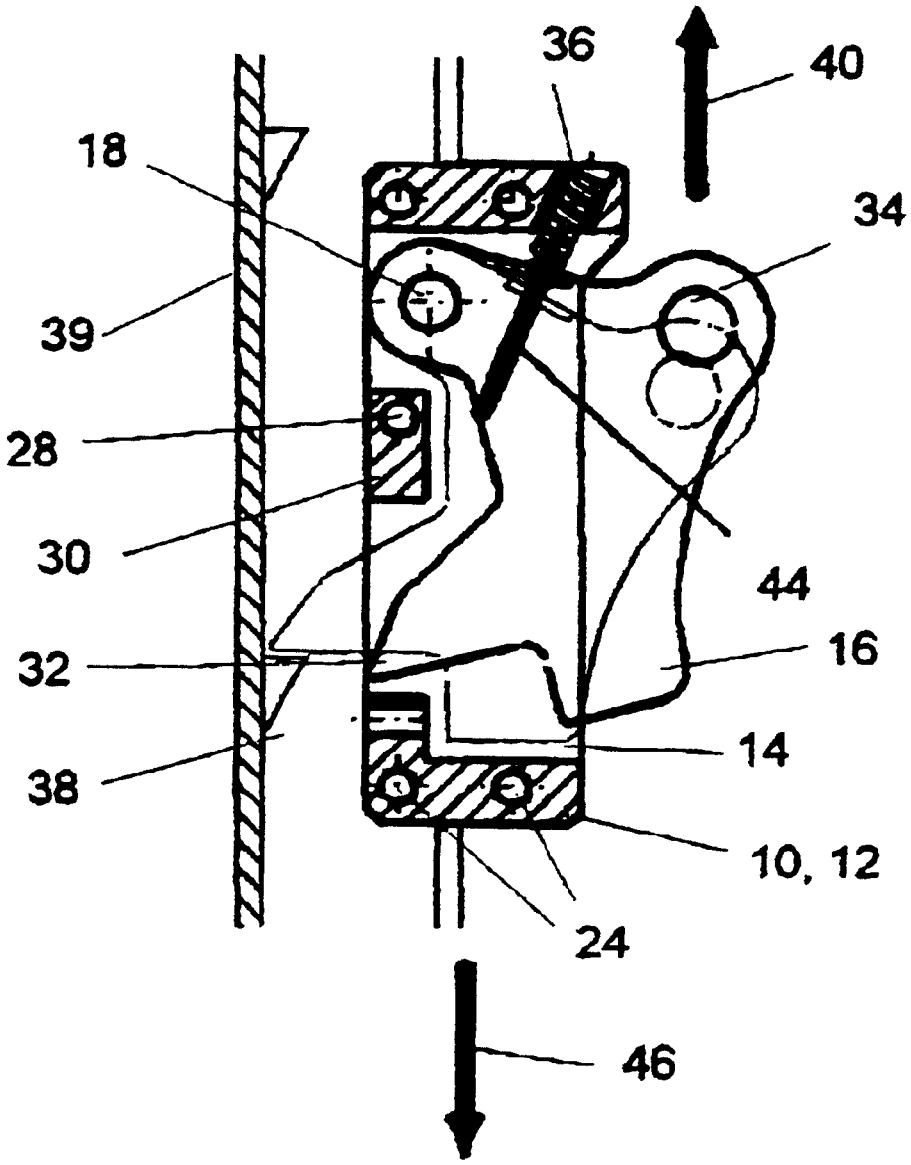

An embodiment of the invention is explained below with reference to the drawing. There are shown in:

FIG. 1 the fall arrester in an isometric view from above front right;

FIG. 2 the fall arrester in an isometric representation from above back right;

FIG. 3 the fall arrester in vertical section, the forces produced upon descent with back-pull being illustrated and FIG. 4 the fall arrester in vertical section, the forces produced upon descent without back-pull being shown.

The fall arrester 10 forms the movable part of a climbing protection system and runs in a guide rail. The secured person wears a safety belt and secures himself to the fall arrester 10 with a connection means and a snap hook.

The fall arrester 10 has a housing 12 with a central opening 14 in which a pawl 16 is housed swivellably about a horizontal axis 18. Guide devices 20, 22 to guide the fall arrester 10 in the guide rail are provided at the top and bottom ends of the fall arrester 10 respectively.

The guide rail has the C profile known from DE 299 06 047 with guide flanges along the opening in the front of the C profile and with a rear wall. The fall arrester 10 is guided in this opening. The guide devices each consist of four fixed rollers 24 which are arranged in pairs so that one roller 24 of each pair rolls along the inside of the guide flange and one along the outside. The rotational axes of the rollers 24 lie parallel to the horizontal rotational axis 18 of the pawl 16.

Slide elements 25 made of low-wear high-density polyethylene with a low friction coefficient, which guide the fall arrester laterally, are inserted between each pair of rollers 24.

In addition, the housing 12 is provided with a widened base 26 which fills almost the total width of the inside of the C profile of the guide rail. The widened base 26 is connected directly at front and rear to fixed rollers. The widened base 26 is interrupted approximately one third from the top by additional fixed rollers 28 which, during use, likewise lie inside the C profile of the guide rail and roll along the inside of the guide flange. With the additional rollers 28, the opening 14 is bridged on the underside of the housing 12 by a plate 30 which reinforces the housing 12 and stabilizes the base 26. The axis of the additional rollers 28 runs within the plate 30.

The horizontal rotational axis 18 of the pawl 16 lies approximately between the top fixed rollers 24 and the additional rollers 28 and approximately in the plane of the axes of these rollers. The pawl 16 has a tip 32 at the bottom end and has an opening 34 as attachment point. The connection lines between the tip 32 and the axis 18 on one side and between the opening 34 and the axis 18 on the other form an angle of approx. 90° at the axis 18. Through a spring 36 pressing from above approximately in the centre between the axis 18 and the opening 34 against the pawl 16, the pawl—seen in FIG. 3 and FIG. 4—is swivelled clockwise so that the tip 32 of the pawl 16 projects on the rear of the fall arrester 10 (FIG. 2). The pawl 16 can be swivelled between a locked position and an unlocked position. In the locked position shown in FIG. 2, the tip 32 projects on the rear side of the fall arrester 10. In the unlocked position, the pawl 16 is swivelled back so that its tip 32 lies flush in the rear of the fall arrester 10 and does not project.

Projecting on the right-hand side of the fall arrester 10 is a pin 37 which, if the fall arrester 10 is incorrectly aligned, runs against a cam cast or screwed onto the left-hand side of the guide rail and holds the fall arrester 10.

A person climbing the ladder wears a safety belt and secures himself to the opening 34 of the pawl 16 by means of a connection means and a snap hook. During ascent, depending on the position assumed by the person, the pawl 16 is swivelled into the unlocked position, which is shown in bold in FIGS. 3 and 4, or, when it is in the locked position, it travels from below over the catching stops 38 in the rear wall 39 of the guide rail.

During descent along a ladder with sufficient space to the rear, the person leans away from the ladder and in the process exerts a tensile force, illustrated by arrow 40, of up to 600 N on the pawl 16. Furthermore, the friction shown by the arrow 42 acts on the fall arrester. The pawl 16 is designed such that the connection line between rotational axis 18 and opening 34 lies approx. 5° below the horizontal when the pawl 16 is then located in the unlocked position, i.e. the tip 32 ends flush with the rear of the fall arrester 10. The torque exerted by the spring 36 on the pawl 16 can be disregarded. After swivelling about an angle of only 14.7°, the pawl 16 reaches the locked position in which the tip 32 on the bottom of the fall arrester 10 projects and strikes against the catching stops 38.

FIG. 4 shows the forces which act on the fall arrester 10 and the pawl 16 when the secured person descends the ladder without back-pull, as is necessary e.g. in narrow shafts or cage ladders. The secured person cannot lean back from the ladder, so that the fall arrester 10 hangs down under its own weight. The arrow 40 is the tensile force acting on the attachment point 34. It therefore points vertically upwards. As the connection line between the rotational axis 18 and the opening 34 lies approximately horizontal, the maximum torque acts on the pawl 16. The spring 36 presses against the pawl 16 approximately in the centre between the axis 18 and the opening 34. The force of the spring 36 which is shown by arrow 44 is chosen such that the torque exerted by it on the pawl 16 is less than the torque produced by the tensile force 40. The magnitude of the tensile force 40 is determined by the weight of the fall arrester 10. It is countered by the weight force shown by the arrow 46.

As the pawl 16 needs to be swivelled by only 14.7° out of the unlocked position in which the connection line between rotational axis 18 and attachment point 34 lies only 2 to 5° below the horizontal in order to reach the locked position, the horizontal path which the attachment point covers is very short. Despite the relatively slight force of the spring 36, full operating safety is therefore guaranteed.

List of reference numbers

| | |
|---|---|
| 10 | Fall arrester |
| 12 | Housing |
| 14 | Opening |
| 16 | Pawl |
| 18 | Rotational axis |
| 20, 22 | Upper, lower guide device |
| 24 | Rollers |
| 25 | Slide elements |
| 26 | Base |
| 28 | Additional rollers |
| 30 | Plate |
| 32 | Tip |
| 34 | Opening, attachment point |
| 36 | Spring |
| 37 | Pin |
| 38 | Catching stop |
| 39 | Guide rail |
| 40 | Tensile force |
| 42 | Friction |
| 44 | Spring force |
| 46 | Weight force |

What is claimed is:

1. A fall arrester for a climbing protection system, the fall arrester being adapted to be guided in a guide rail and to take a locked and an unlocked position in the guide rail, the fall arrester comprising:

a housing;

a pawl housed in the housing rotatable about an axis, the pawl including an attachment point to which a person to be secured can be connected by connecting means, the pawl being adapted to be swiveled to bring the fall arrester in the unlocked and locked positions; and a spring exerting a torque on the pawl for loading the pawl into the locked position;

wherein the pawl is designed such that in the unlocked position a connection line between the rotational axis and the attachment point forms an acute angle to the horizontal, and in the unlocked position the connection line between the rotational axis and the attachment point forms an angle greater than 2° to the horizontal; and wherein the torque exerted by the spring on the pawl is less than the torque produced by the weight force of the fall arrester when the fall arrester is held at the attachment point; and wherein in the unlocked position the connection line between the rotational axis and the attachment point forms an angle of approximately 5° to the horizontal.

2. A fall arrester for a climbing protection system, the fall arrester being adapted to be guided in a guide rail and to take a locked and an unlocked position in the guide rail, the fall arrester comprising:

a housing, a pawl housed in the housing rotatable about an axis, the pawl including an attachment point to which a person to be secured can be connected by connecting means, the pawl being adapted to be swivelled to bring the fall arrester in the unlocked and locked positions;

a spring exerting a torque on the pawl for loading the pawl into the locked position;

wherein the pawl is designed such that in the unlocked position the connection line between the rotational axis and the attachment point forms an acute angle to the horizontal, and in the unlocked position the connection line between the rotational axis and the attachment point forms an angle greater than 2° to the horizontal;

wherein the torque exerted by the spring on the pawl is less than the torque produced by the weight force of the fall arrester when the fall arrester is held at the attachment point;

wherein the rotational axis of the pawl is located at the top end of the fall arrester; and;

further comprising a guide device at the top end, a guide device at the bottom end, and an additional guide device in the center of the fall arrester, the rotational axis of the pawl being arranged approximately in the center between the additional guide device and the guide device at the top end of the fall arrester.

* * * * *

UNITED STATES PATENT AND TRADEMARK OFFICE

CERTIFICATE OF CORRECTION

PATENT NO. : 6,725,969 B1
DATED : April 27, 2004
INVENTOR(S) : Klaus Meister

It is certified that error appears in the above-identified patent and that said Letters Patent is hereby corrected as shown below:

Column 2,
Line 25, now reads "approx. 150°" should read -- approx. 15° --.

Signed and Sealed this

Twenty-seventh Day of July, 2004

JON W. DUDAS
*Acting Director of the United States Patent and Trademark Office*